United States Patent [19]

Nitschko

[11] 4,431,210

[45] Feb. 14, 1984

[54] SKI BINDING JAW, IN PARTICULAR A FRONT JAW

[75] Inventor: Theodor Nitschko, Vienna, Austria

[73] Assignee: TMC Corporation, Baar, Switzerland

[21] Appl. No.: 285,195

[22] Filed: Jul. 20, 1981

[30] Foreign Application Priority Data

Aug. 6, 1980 [AT] Austria ..... 4048/80

[51] Int. Cl.[3] ..... A63C 9/085

[52] U.S. Cl. ..... 280/625; 280/629; 280/634

[58] Field of Search ..... 280/625, 628, 629, 633, 280/634, 632

[56] References Cited

U.S. PATENT DOCUMENTS

| | | | |
|---|---|---|---|
| 3,902,730 | 9/1975 | Tschida et al. | 280/625 |
| 4,088,343 | 5/1978 | Krob . | |
| 4,170,371 | 10/1979 | Weigl et al. | 280/625 |
| 4,288,094 | 9/1981 | Svoboda | 280/634 |

*Primary Examiner*—David M. Mitchell

*Attorney, Agent, or Firm*—Flynn, Thiel, Boutell & Tanis

[57] ABSTRACT

A ski binding front jaw has a support member and a slide member which are independently supported for movement longitudinally of the ski. The support member has a pair of two-arm sole holder levers supported for pivotal movement about vertical axes, a first arm of each sole holder being adapted to engage a ski boot and the second arm engaging the slide member. A spring engages the support member and slide member and urges them rearwardly and forwardly, respectively, the slide member in turn urging the sole holders pivotally so that the second arms thereof are urged against the ski boot. Respective stops limit forward and rearward movement of the slide member and support member, respectively. A forward force exerted on the support member moves it forwardly relative to the slide member against the force of the spring, so that the first arms of the sole holders become spaced from the slide member and the second arms of the sole holders can pivot freely outwardly.

8 Claims, 3 Drawing Figures

SKI BINDING JAW, IN PARTICULAR A FRONT JAW

FIELD OF THE INVENTION

The invention relates to a front jaw for a safety ski binding and, more particularly, to a jaw which includes a support member carrying a pair of symmetrically arranged, two-arm sole holders which are supported for pivotal movement about vertical bolts and each has one arm engaging the sole of a ski shoe and the other arm engaging a member which is movable against the force of a spring longitudinally of the ski, the spring having one end supported on the support member and its other end supported on an abutment which is adjustable by means of an adjusting screw.

BACKGROUND OF THE INVENTION

A jaw of the above-mentioned type is described for example in Austrian Pat. No. 315 041. The movable part of this construction is designed in the form of a rack as a body of revolution with at least one rotating groove, and is supported movably in the longitudinal center plane of the jaw between the bolts of the sole holder, so that extensions on the sole holders engage the grooves of the rack. If a lateral force acts onto a clamped-in ski shoe, then both sole holders swing outwardly and the rack is hereby pulled backwardly by the extensions against the force of the spring. An important disadvantage of this conventional construction is that high frictional forces occur between the ski shoe sole and the sole holder when forces act on the sole holder in a direction toward the tip of the ski, as occurs for example during a forward fall of the skier, which frictional forces delay or prevent a release of the jaw and can thus cause injuries to the skier.

The purpose of the invention is to bring help here and to provide a jaw of the above-mentioned type which compensates for the frictional forces which occur when a force acts on the jaw in a direction toward the tip of the ski, so that the release force is preferably maintained substantially constant.

SUMMARY OF THE INVENTION

This purpose is attained inventively by providing a jaw of the foregoing type in which the support member is supported for movement in the longitudinal direction of the ski and the abutment for the spring is fixed against movement relative to the ski in response to a force which acts onto the jaw in a direction toward the tip of the ski. Through this measure, it is possible in response to a forward force to move the support member which carries the two sole holders in a direction toward the tip of the ski until the sole holders are no longer biased by the spring and an easier release of the ski shoe is assured. Also, the inventive measures prevent deformation of the ski shoe during flexing of the ski and allow the lateral release force to remain constant even when a force which is directed toward the tip of the ski acts onto the jaw.

A further characteristic of the invention consists in the support member having a support plate which is movably supported on a ski-fixed guide rail and also having an upwardly projecting portion on which the one end of the spring is supported. This construction contributes considerably to the compact design of the jaw.

A further inventive development is characterized by providing on the front area of the guide rail a ski-fixed support part which is advantageously and preferably constructed in one piece with the guide rail, against which support part the abutment for the spring can be supported through the adjusting screw. If the support member moves forwardly then, because the support member is ski-fixed, the unbiasing of the sole holders is assured.

According to a further characteristic of the invention, it is provided that the member which is movable against the force of the spring is constructed as a slide member which preferably has an indicator and has a bent section which engages the arms of the sole holders, and that a draw rod is disposed coaxially within the spring and has one end secured on the bent section of the slide member and the other end held rotatably in the adjusting screw. These measures also assure, when a force acts horizontally onto the sole holders, that a swinging out of the sole holders against the force of the spring occurs, the slide member effecting a compressing of the spring and the support member remaining stationary so that the desired release force exists.

BRIEF DESCRIPTION OF THE DRAWINGS

The invention will now be described in greater detail in connection with the drawing, which illustrates one exemplary embodiment.

In the drawing.

DETAILED DESCRIPTION

Figure 1:
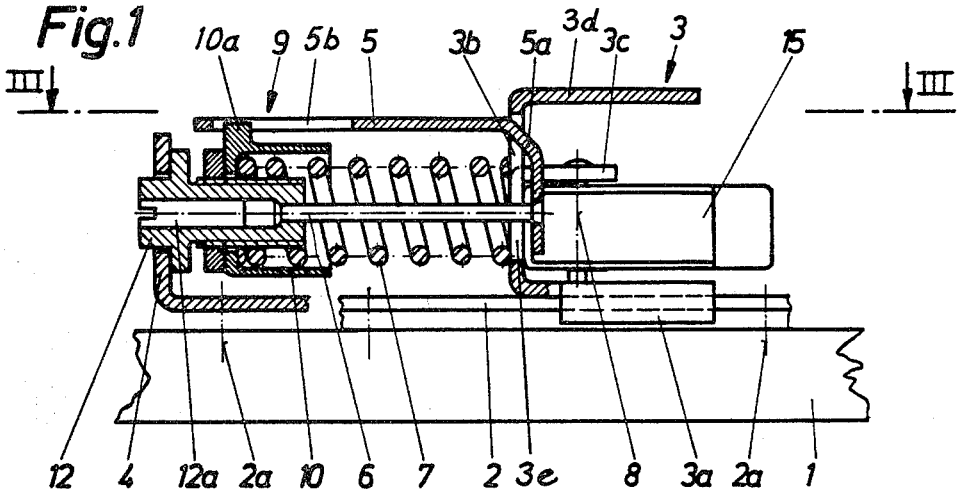
FIG. 1 is a sectional side view of an inventive ski binding front jaw taken along the line I—I of FIG. 3.
Figure 3:
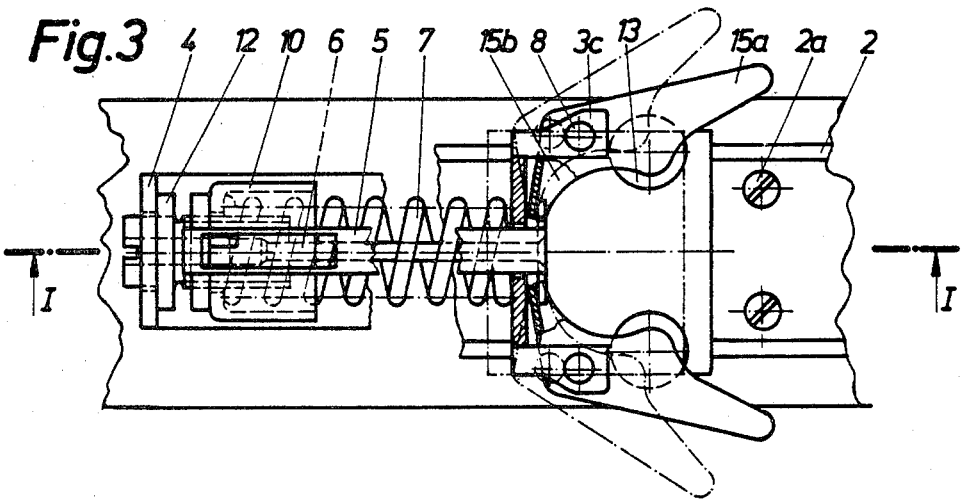
FIG. 3 is a sectional top view of the jaw of FIG. 1 taken along the line III—III of FIG. 1, wherein the operational position according to FIG. 2 is illustrated in dash-dotted lines.

Referring to FIG. 1, the front jaw has a guide rail 2 which is secured on the upper side of a ski 1 by means of screws 2*a* (FIG. 3). A support plate 3*a* of a support member 3 is supported on the guide rail 2 for movement in the longitudinal direction of the ski 1. Movement of the support member 3 in the direction of the not-illustrated heel holder is limited by a conventional and not-illustrated stop which is formed, for example, by a not-illustrated stepping plate. Starting from the end area of the support plate 3*a*, which end area faces the tip of the ski, the support member 3 has a portion 3*b* which is positioned normally with respect to the upper side of the ski and carries at each side approximately in its vertical center a fastening piece 3*c* which extends parallel to the upper side of the ski. The portion 3*b* transfers at its upper end area into a portion 3*d* which extends approximately at a right angle thereto and supports a not-illustrated sole hold-down which is adapted to engage the top of a ski boot sole. The sole hold-down can be supported pivotally on a vertical bolt which is also not illustrated and can be moved vertically by rotating the bolt so as to adjust the hold-down for different thickness ski shoe soles. The hold-down is conventional, is not the subject matter of the present invention and is therefore not illustrated or described in detail.

An opening 3*e* is provided through the vertical portion 3*b* of the support member 3, and a slide member 5 which is slightly narrower than the width of the opening 3e extends therethrough. The structure and function of the slide member 5 are described in greater detail hereinafter.

Two sole holders which are designed in a conventional manner and which are constructed advantageously as bell cranklike levers 15 are each supported pivotally by means of a respective bolt 8 which is mounted normal to the upper side of the ski on the support plate 3a and/or on a fastening piece 3c. The levers 15 each have one arm 15a (FIG. 3) which is adapted to engage a not-illustrated ski shoe sole and a second arm 15b (FIG. 3) which extends inwardly toward the longitudinal axis of the ski and engages a downwardly bent section 5a of the slide member 5. Furthermore, rollers 13 are rotatably supported on the sole holder levers 15 and, as is actually known, reduce the sliding frictional forces which would otherwise occur during a lateral release between the ski shoe sole and the levers 15.

A helical compression spring 7 has one end engaging the portion 3b of the support member 3 which extends vertically with respect to the upper side of the ski, the spring 7 being wider than the opening 3e in the portion 3b. The other end of the spring 7 is supported in a sleevelike spring abutment 10. The initial tension of the spring 7 can be adjusted in a conventional manner by means of an adjusting screw 12 which threadedly engages the abutment 10 and is rotatably supported against a ski-fixed support part or stop 4. The support part 4 is preferably constructed in one piece with the guide rail 2. A conventional indicating device 9 is provided and consists substantially of an indicator 10a which is provided on the spring abutment 10 and projects into a window 5b provided in the slide member 5, thereby permitting a visual reading of the adjusted initial tension of the spring 7.

A draw rod 6 which extends coaxially within the helical spring 7 has one end secured on the bent section 5a of the slide member 5 and the other end held rotatably in an opening 12a in the adjusting screw 12.

The operation of the inventive jaw is very simple. When a force from a not illustrated ski shoe sole acts horizontally and laterally outwardly onto one of the levers 15, the lever arm 15a pivots outwardly about its bolt 8 as the boot exits the binding. During this swivelling movement, the lever arm 15b moves the slide member 5, together with the draw rod 6, the adjusting screw 12 and the abutment 10, longitudinally of the ski toward the not illustrated sole hold-down and away from the support part 4 against the force of the spring 7 which is supported on the support member 3, so that the spring 7 is compressed.

Figure 2:
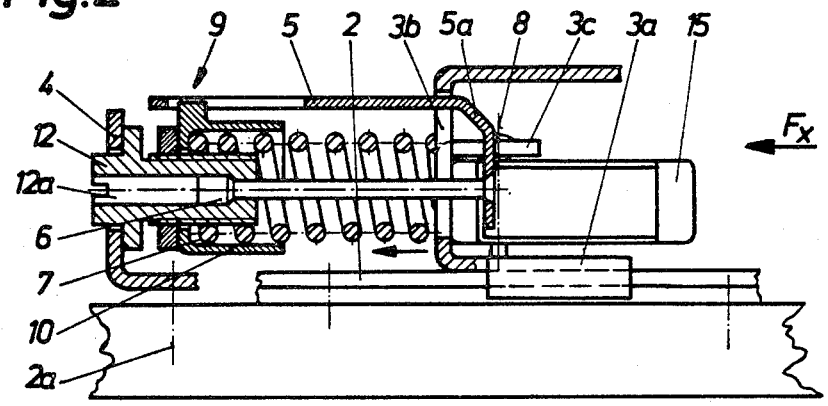
FIG. 2 is a sectional side view similar to FIG. 1 illustrating the jaw in a different position of operation which is caused by a force acting onto it in a direction toward the tip of the ski.

When a force acts on the not illustrated sole hold-down and thus the support member 3 in a direction toward the tip of the ski, as is indicated in FIG. 2 by the arrow $F_x$, then the support member 3 moves forwardly on the guide rail 2 and compresses the spring 7, the abutment 10 of which is now supported by the adjusting screw 12 on the ski-fixed support part 4. The levers 15 thus become unbiased and can swing freely outwardly. This position of the levers 15 is indicated in dash-dotted lines in FIG. 3.

In other words, the support member 3 is moved forwardly on the guide rail 2 relative to the slide member 5 by the forward force $F_x$ exerted on the not illustrated sole hold-down provided on the support member 3. Forward movement of the slide member 5 and spring abutment 10 is prevented by the engagement of the adjusting screw 12 with the ski-fixed support part 4. The levers 15 are supported on and move forwardly with the support member 3, so that the arms 15b of the levers 15 become spaced from the bent section 5a of the slide member 5. This permits the levers 15 to pivot freely within a certain range, so that their arms 15a can pivot laterally outwardly to facilitate the exit of the ski boot from the binding.

Therefore, when travelling through a depression, the deforming of the ski shoe which is not illustrated is prevented. In the case of a forward fall, the additional frictional forces which occur between the ski shoe sole and the levers 15 are compensated for, so that a simultaneously occurring fall of the skier does not result in increased release forces at the front jaw, but rather the release force remains constant.

The invention is not limited to the illustrated exemplary embodiment. Further modifications are possible, including the rearrangement of parts, without leaving the scope of the present invention. Thus, the inventive measures can be applied to a plurality of existing ski binding jaw systems.

The embodiment of the invention in which an exclusive property or privilege is claimed is defined as follows:

1. A safety ski binding jaw adapted to be mounted on a ski, comprising a first member having two bolts thereon which are arranged symmetrically with respect to the longitudinal center plane of the ski and are substantially perpendicular to the upper side of the ski, each said bolt pivotally supporting a respective sole holder, said sole holders each having a first arm which can engage the sole of a ski shoe and a second arm which can engage a second member which is supported for movement relative to said first member longitudinally of the ski, and a release spring having one end supported on said first member and its other end supported on an abutment on said second member which can be positionally adjusted longitudinally of the ski relative to said second member by means of an adjusting screw, said first member being supported for movement longitudinally of the ski on a guide rail which can be secured to the ski and has in a front region thereof a support part which said adjusting screw for said abutment for said spring can engage to limit forward movement of said second member relative to said guide rail.

2. A saftey ski binding jaw adapted to be mounted on a ski, comprising a first member having two bolts thereon which are arranged symmetrically with respect to the longitudinal center plane of the ski and are substantially perpendicular to the upper side of the ski, each said bolt pivotally supporting a respective sole holder, said sole holders each having a first arm which can engage the sole of a ski shoe and a second arm which is supported on a second member which is supported for movement relative to said first member longitudinally of the ski, release spring having one end supported on a portion of said first member and its other end supported on an abutment on said second member which can be positionally adjusted longitudinally of the ski relative to said second member by means of an adjusting screw, said first member being supported for movement longitudinally of the ski on a guide rail which can be secured to the ski, and including limit means for limiting movement of said adjustable abutment toward the tip of the ski relative to said guide rail, said jaw being free of means for releasably locking said first member against movement relative to said guide rail, whereby said first member is movable toward the tip of the ski, in every position of said sole holders, toward the tip of the ski against the urging of said release spring.

3. The jaw according to claim 2, wherein said limit means is provided on said guide rail of said adjustable abutment for said release spring toward the relative to said guide rail in response to a force which acts onto the first member in a direction toward the tip of the ski.

4. The jaw according to claim 3, wherein said limit means includes a support part on said guide rail which can engage said adjusting screw of said abutment for said release spring to limit movement thereof toward the tip of the ski.

5. The jaw according to claim 2, wherein said release spring is a helical compression spring, wherein said second member includes a slide member which has a bent section which is engaged by said second arms of said sole holders, and including a draw rod disposed coaxially within said release spring, one end of said draw rod being secured to said bent section of said slide member and the other end thereof rotatably supporting said adjusting screw.

6. A jaw for a safety ski binding adapted to releasably hold a ski boot on a ski, comprising a guide which is adapted to be mounted on the ski; a first member supported on said guide for reciprocal movement in a first direction longitudinally of the ski and toward the ski boot and a second direction opposite said first direction; a second member supported for reciprocal movement in said first and second directions independently of said first member; resilient means cooperable with said first and second members for respectively, yieldably urging them in said first and second directions relative to each other; two sole holders supported on said first member for pivotal movement about respective, laterally spaced, approximately vertical axes, each said sole holder having a first portion engageable with the ski boot and a second portion engageable with said second member, pivotal movement of one of said sole holders causing said second member to move in said first direction relative to said first member against the urging of said resilient means; and means for limiting movement of said second member in said second direction relative to said guide; and wherein said jaw is free of means for releasably locking said first member against movement in said second direction relative to said guide.

7. The jaw of claim 6, wherein said limit means includes a support part on said guide which is positioned along the path of movement of said second member for engagement therewith, engagement of said second member and said support part preventing further movement of said second member in said second direction.

8. The jaw of claim 7, wherein said first member has a substantially upright, transversely extending wall having an opening therethrough; wherein said second member has a first portion on the side of said wall nearest the ski boot, said second portions of said sole holders being disposed between said wall of said first member and said first portion of said second member; wherein said second member has a draw rod secured to said first portion thereof and extending in said first direction through said opening in said wall of said first member, an adjusting screw rotatably supported on said draw rod at a location remote from said first portion of said second member, an abutment threadedly engaging said adjusting screw, a further portion adjacent said abutment which has a window therein, and an indicator on said abutment which is slidably received within said window; and wherein said resilient means includes a helical compression spring which coaxially encircles said draw rod, has one end supported on said wall of said first member and has its other end supported on said abutment.

* * * * *

UNITED STATES PATENT AND TRADEMARK OFFICE

CERTIFICATE OF CORRECTION

PATENT NO. : 4 431 210

DATED : February 14, 1984

INVENTOR(S) : Theodor Nitschko

It is certified that error appears in the above-identified patent and that said Letters Patent is hereby corrected as shown below:

Col. 4, line 58; after "ski," insert ---a---.

Col. 5, line 1; after "movement" insert ---toward the tip of the ski---.

lines 2 and 3; delete "toward the tip of the ski".

line 7; change "of said adjustable" to a period.

lines 8-10; delete in their entirety.

Signed and Sealed this

*Twenty-sixth* Day of *June 1984*

[SEAL]

*Attest:*

GERALD J. MOSSINGHOFF

*Attesting Officer*

*Commissioner of Patents and Trademarks*